US005133317A

United States Patent [19]

Sakita

[11] Patent Number: 5,133,317

[45] Date of Patent: Jul. 28, 1992

[54] ROTARY PISTON ENGINE

[76] Inventor: Masami Sakita, 1259 El Camino Real #121, Menlo Park, Calif. 94025

[21] Appl. No.: 712,562

[22] Filed: Jun. 10, 1991

[51] Int. Cl.[5] ..... F02B 53/00

[52] U.S. Cl. ..... 123/234; 123/61 R; 418/36; 418/112; 418/142; 418/185; 74/211; 74/570

[58] Field of Search ..... 123/51 R, 51 A, 61 R, 123/63, 51 B, 234, 236, 221, 245; 418/15, 36, 185, 112, 142; 74/63, 116, 211, 570

[56] References Cited

U.S. PATENT DOCUMENTS

| | | | |
|---|---|---|---|
| 2,155,249 | 4/1939 | Bancroft | 123/234 |
| 2,413,590 | 12/1946 | Snyder | 418/36 |
| 2,804,059 | 8/1957 | Honjyo | 123/11 |
| 2,840,058 | 6/1958 | Stringer | 418/185 |
| 3,256,866 | 6/1966 | Bauer | 123/11 |
| 3,312,200 | 4/1967 | Benson | 123/234 |
| 3,327,692 | 6/1967 | Keagle | 123/43 |
| 3,396,632 | 8/1968 | LeBlanc | 91/60 |
| 3,398,643 | 8/1968 | Schudt | 91/60 |
| 3,807,368 | 4/1974 | Johnson | 123/245 |
| 4,086,882 | 5/1978 | McCrum | 123/216 |
| 4,437,441 | 3/1984 | Menioux | 123/245 |
| 4,646,694 | 3/1987 | Fawcett | 123/245 |
| 4,901,694 | 2/1990 | Sakita | 123/234 |

FOREIGN PATENT DOCUMENTS

| | | | |
|---|---|---|---|
| 2325253 | 11/1974 | Fed. Rep. of Germany | 418/185 |
| 58-79623 | 5/1983 | Japan | 123/245 |
| 15623 | 6/1910 | United Kingdom | 123/234 |

*Primary Examiner*—David A. Okonsky
*Attorney, Agent, or Firm*—Victor R. Beckman

[57] ABSTRACT

A rotary piston engine is shown which includes a housing (22) having a cylindrical working chamber with inlet (88) and exhaust (86) ports. First and second piston assemblies (30 and 32) each of which includes at least one pair of diametrically wedge-shaped pistons (30A and 30B, and 32A and 32B) are located in the working chamber. The piston assemblies rotate in the same direction at recurrently variable speeds so that one pair of diametrically opposite sub-chambers decreases in volume while the other pair increases in volume. In FIG. 1, four eccentric elliptical gear sets (60, 62, 64 and 66) interconnect coaxial piston shafts (38 and 36B). Compound eccentric elliptical gear sets (106 and 108) for interconnection of the piston shafts are shown in FIG. 7. Gear trains of large effective eccentricity are employed such that during the power phase of engine operation the trailing piston rotates only a small amount for efficient engine operation.

23 Claims, 14 Drawing Sheets

FIG-6A

| POSITION | SUB-CHAMBER BETWEEN PISTONS | A 30A & 32A | B 32A & 30B | C 30B & 32B | D 32B & 30A |
|---|---|---|---|---|---|
| 1 | 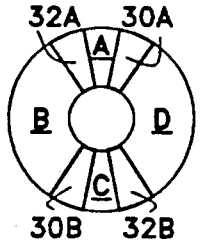 | IGNITION (POWER) | START OF COMPRES-SION | START OF AIR/FUEL INTAKE | START OF EXHAUST |
| 2 | 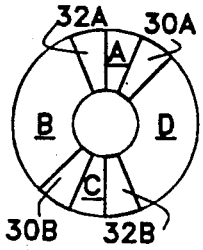 | EXPANSION (POWER) | COMPRES-SION | AIR/FUEL INTAKE | EXHAUST |
| 3 | 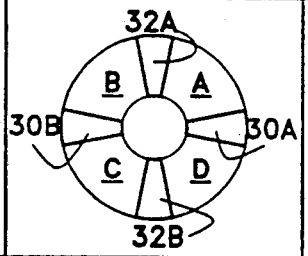 | EXPANSION (POWER) | COMPRES-SION | AIR/FUEL INTAKE | EXHAUST |
| 4 | 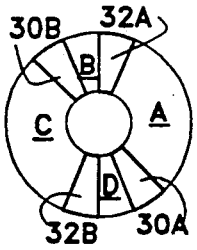 | EXPANSION (POWER) | COMPRES-SION | AIR/FUEL INTAKE | EXHAUST |
| 5 | 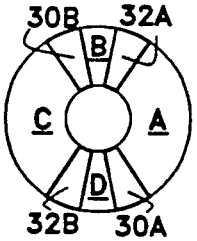 | END OF EXPANSION (POWER) | END OF COMPRES-SION | END OF AIR/FUEL INTAKE | END OF EXHAUST |

FIG-6B

| POSITION | SUB-CHAMBER BETWEEN PISTONS | A 30A & 32A | B 32A & 30B | C 30B & 32B | D 32B & 30A |
|---|---|---|---|---|---|
| 1 | 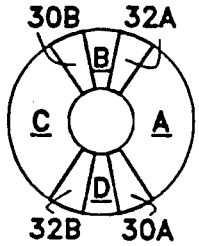 | START OF EXHAUST | IGNITION (POWER) | START OF COMPRES-SION | START OF AIR/FUEL INTAKE |
| 2 | 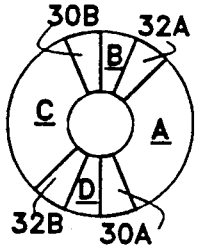 | EXHAUST | EXPANSION (POWER) | COMPRES-SION | AIR/FUEL INTAKE |
| 3 | 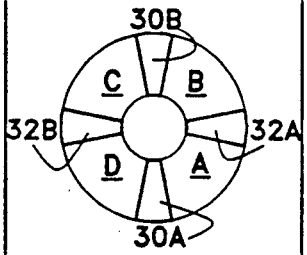 | EXHAUST | EXPANSION (POWER) | COMPRES-SION | AIR/FUEL INTAKE |
| 4 | 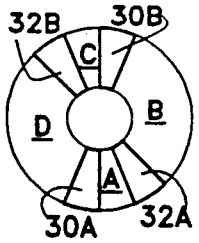 | EXHAUST | EXPANSION (POWER) | COMPRES-SION | AIR/FUEL INTAKE |
| 5 | 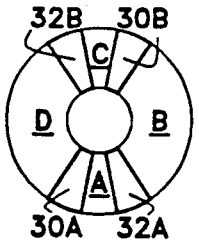 | END OF EXHAUST | END OF EXPANSION (POWER) | END OF COMPRES-SION | END OF AIR/FUEL INTAKE |

FIG-6C

| POSITION | SUB-CHAMBER BETWEEN PISTONS | A 30A & 32A | B 32A & 30B | C 30B & 32B | D 32B & 30A |
|---|---|---|---|---|---|
| 1 | 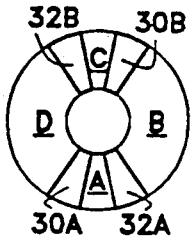 | START OF AIR/FUEL INTAKE | START OF EXHAUST | IGNITION (POWER) | START OF COMPRES-SION |
| 2 | 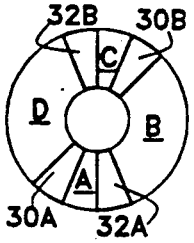 | AIR/FUEL INTAKE | EXHAUST | EXPANSION (POWER) | COMPRES-SION |
| 3 | 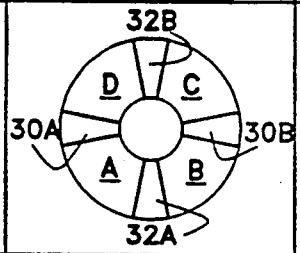 | AIR/FUEL INTAKE | EXHAUST | EXPANSION (POWER) | COMPRES-SION |
| 4 | 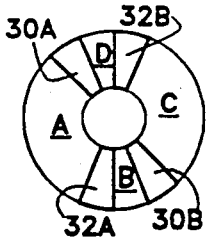 | AIR/FUEL INTAKE | EXHAUST | EXPANSION (POWER) | COMPRES-SION |
| 5 | 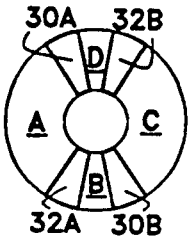 | END OF AIR/FUEL INTAKE | END OF EXHAUST | END OF EXPANSION (POWER) | END OF COMPRES-SION |

FIG-6D

| POSITION | SUB-CHAMBER BETWEEN PISTONS | A 30A & 32A | B 32A & 30B | C 30B & 32B | D 32B & 30A |
|---|---|---|---|---|---|
| 1 | 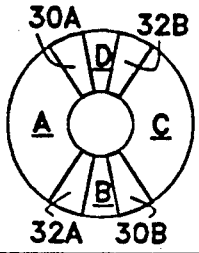 | START OF COMPRES-SION | START OF AIR/FUEL INTAKE | START OF EXHAUST | IGNITION (POWER) |
| 2 | 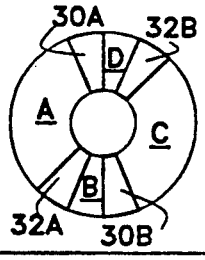 | COMPRES-SION | AIR/FUEL INTAKE | EXHAUST | EXPANSION (POWER) |
| 3 | 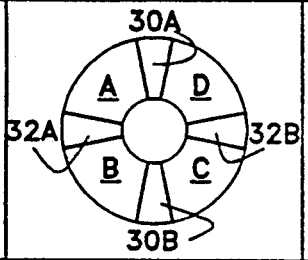 | COMPRES-SION | AIR/FUEL INTAKE | EXHAUST | EXPANSION (POWER) |
| 4 | 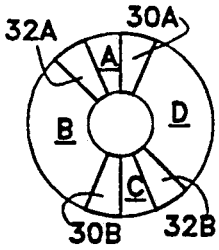 | COMPRES-SION | AIR/FUEL INTAKE | EXHAUST | EXPANSION (POWER) |
| 5 | 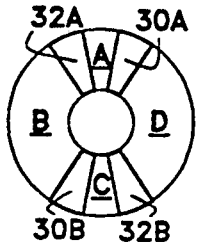 | END OF COMPRES-SION | END OF AIR/FUEL INTAKE | END OF EXHAUST | END OF EXPANSION (POWER) |

ROTARY PISTON ENGINE

FIELD OF THE INVENTION

This invention relates generally to rotary piston engines and in particular to rotary piston engines which include eccentric elliptical gears in the interconnection of rotating piston assemblies.

BACKGROUND OF THE INVENTION

The conventional reciprocating internal combustion engine produces power by converting heat energy to up-and-down mechanical energy of pistons which then is converted to rotational energy that drives the drive shaft. However, up and down piston movements induce unnecessary energy loss and unbalanced piston movements.

A currently commercially available rotary engine, i.e. the Wankel engine, is compact, light weight, simple in design, and capable of producing high torque output. However, it is not fuel efficient because of inherent engine design problems, such as the shape of the piston and piston housing.

Rotary engines which include a housing formed with a cylindrical shaped chamber in which one or more pairs of pistons are located are well known. Engines of this type are shown, for example, in U.S. Pat. Nos. 4,901,694—Sakita; 4,646,694—Fawcett; 3,398,643—Schudt; 3,396,632—Leblanc; 3,256,866—Bauer; and 2,804,059—Honjyo.

Problems with prior art rotary engines of the above-mentioned type include 1) the engine is not energy efficient because energy consumed by the following piston is excessively large, and 2) piston construction is complex, and sealing between pistons, and between pistons and the cylinder walls is difficult. A major cause of energy loss in such prior art rotary engines is due to dragging of the following, or trailing, piston in the angularly forward direction during the power, or expansion, phase of engine operation. This energy loss can be minimized by minimizing the amount of displacement of the following piston between the start and end of the power phase relative to the displacement of the leading piston. The sealing problem may be improved by adopting a different piston design.

SUMMARY AND OBJECTS OF THE INVENTION

An object of this invention is the provision of an improved rotary piston engine which avoids the above-mentioned problems of inefficient energy use due to the large angular rotation of following pistons during the power phase of the engine.

An object of this invention is the provision of a gear train that assures small angular movement of the trailing pistons during the power phase of the engine.

An object of this invention is the provision of a set of compound eccentric ellipsoidal gears which remain engaged regardless of the amount of ellipticity of the gears.

An object of this invention is the provision of an improved rotary engine which avoids the above-mentioned problems and difficulties in sealing between pistons, and between the pistons and the cylinder walls.

The present invention includes a cylindrical shaped housing forming a cylindrical working chamber within which first and second piston assemblies rotate about the cylinder axis. Each piston assembly includes one or more pairs of diametrically opposed pistons which divide the chamber into a plurality of pairs of diametrically opposed sub-chambers. Where each piston assembly includes a single pair of diametrically opposed pistons, four sub-chambers are provided. The first and second piston assemblies are interconnected by a plurality of pairs of intermeshing eccentric elliptical gears, each of which pairs rotate in substantially the same phased relationship for rotation of the first and second piston assemblies in the same direction at recurrently variable speeds. With one complete revolution of the piston assemblies four complete engine operating cycles are completed for a 4-piston engine, and eight complete operating cycles are completed for an 8-piston engine, where each operating cycle includes power, exhaust, intake and compression phases.

Pistons of the first piston assembly are rigidly supported between rotatably mounted, spaced, axially aligned tubular piston shaft sections. An inner piston shaft is coaxially located in the tubular shaft sections and extends therebetween, to which inner piston shaft pistons of the second piston assembly are attached. The piston shafts are interconnected through a gear train which includes two pairs of circular gears and two or more pairs of eccentric elliptical gears which provide for rotation of the piston assemblies at recurrently variable speeds whereby sub-chambers of recurrently variable volume are provided. The gear ratio of the pairs of circular gears is determined by the number of pistons included in the piston assembly and number of intended rotations per combustion. A 1:2 gear ratio is employed for piston assemblies each of which include one pair of diametrically opposed pistons, and a 1:4 gear ratio is employed for piston assemblies each of which include two pairs of diametrically opposed pistons.

During each power phase, the leading piston completes a little less than one-half rotation in the two-piston per piston assembly engine, or a little less than a quarter rotation in the four-piston per piston assembly engine, while the trailing piston rotates a relatively small amount. The relative rotation of leading and trailing pistons is determined by the ellipsoidal gears included in the gear train which interconnects the piston assemblies. In one embodiment of the invention, at least four pairs of eccentric elliptical gears are included in the gear train, all of which rotate in substantially the same phased relationship. By using more than two pairs of eccentric ellipsoidal gears in the gear train, a small angular motion of trailing pistons during the power phase is assured. In another embodiment compound eccentric elliptical gears are employed which in addition to the generally radially extending teeth also include generally axially extending teeth in an eccentric elliptical pattern at at least one face of the gears. An idler gear in engagement with the generally axially extending teeth on intermeshing ellipsoidal gears provides for a second gear connection therebetween to avoid unintentional disengagement of the compound ellipsoidal gears.

The engine air inlet port may be used to provide an air/fuel mixture to the engine. Alternatively, fuel may be injected directly into the sub-chamber during the compression phase of the operating cycle. In either case, a spark plug may be used to ignite the fuel. In another modified form of this invention, operation by compression ignition is provided, in which case no spark plug is required. Instead, high pressure fuel injection means for injecting fuel into the hot compressed air in the combustion section when the combustion section sub-chamber volume is substantially minimum are provided. For compression ignition, compression to a higher pressure so as to raise the compressed air temperature to the ignition temperature of the fuel is required. In another modified form of this invention, spark plugs are carried by the pistons in which case ignition by the spark plugs well before or after two neighboring pistons are at their closest positions is possible.

BRIEF DESCRIPTION OF THE DRAWINGS

The invention, together with other objects and advantages thereof, will be better understood from the following description with the accompanying drawings. It will be understood that the illustrated embodiments of the invention included herein are by way of example only and that the invention is not limited thereto. In the drawings, wherein like reference characters refer to the same parts in the several views:

FIGS. 6A through 6D schematically illustrate a sequence of operational positions of the engine;

FIGS. 9A-1 through 9E-1 schematically illustrate different eccentric ellipsoidal gear trains;

Figure 1:
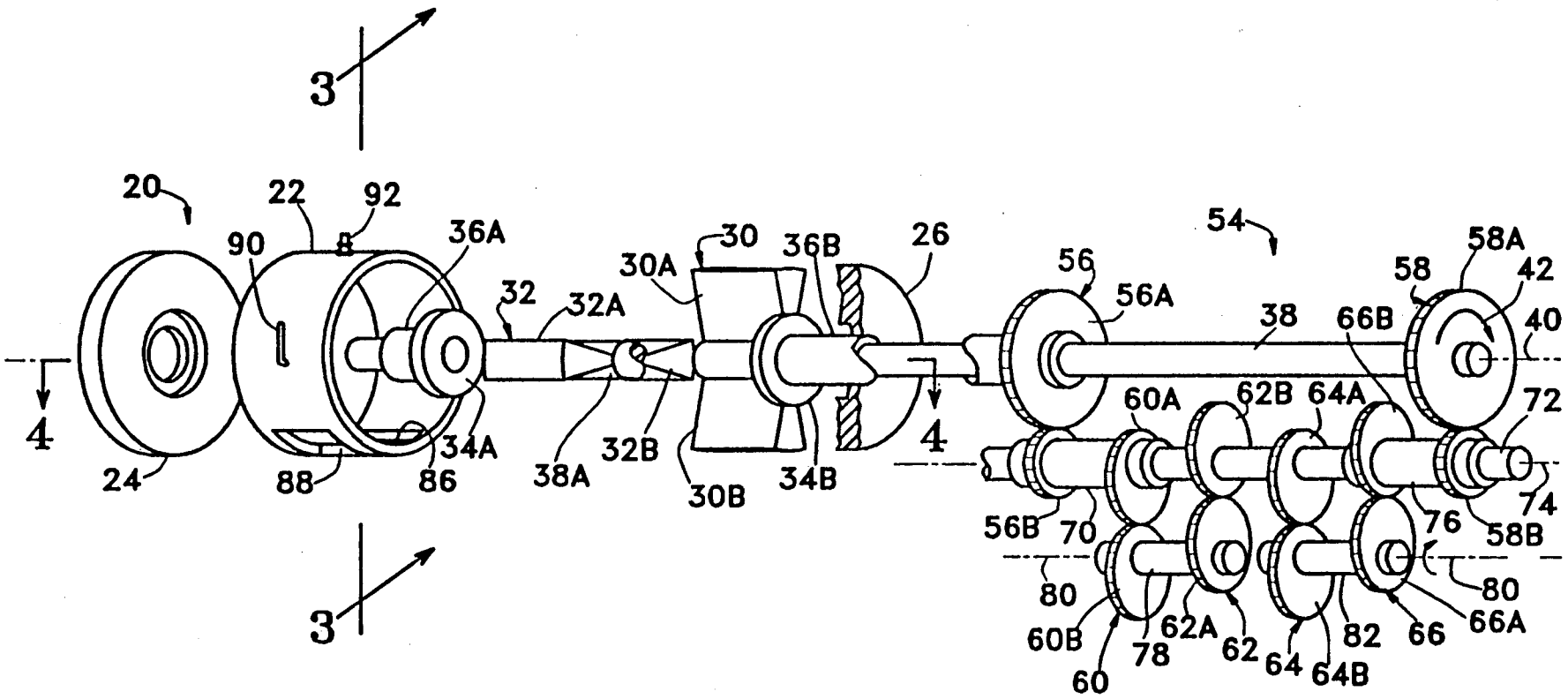
FIG. 1 is an exploded isometric view, partly in section, of a rotary engine embodying the present invention.
Figure 2:
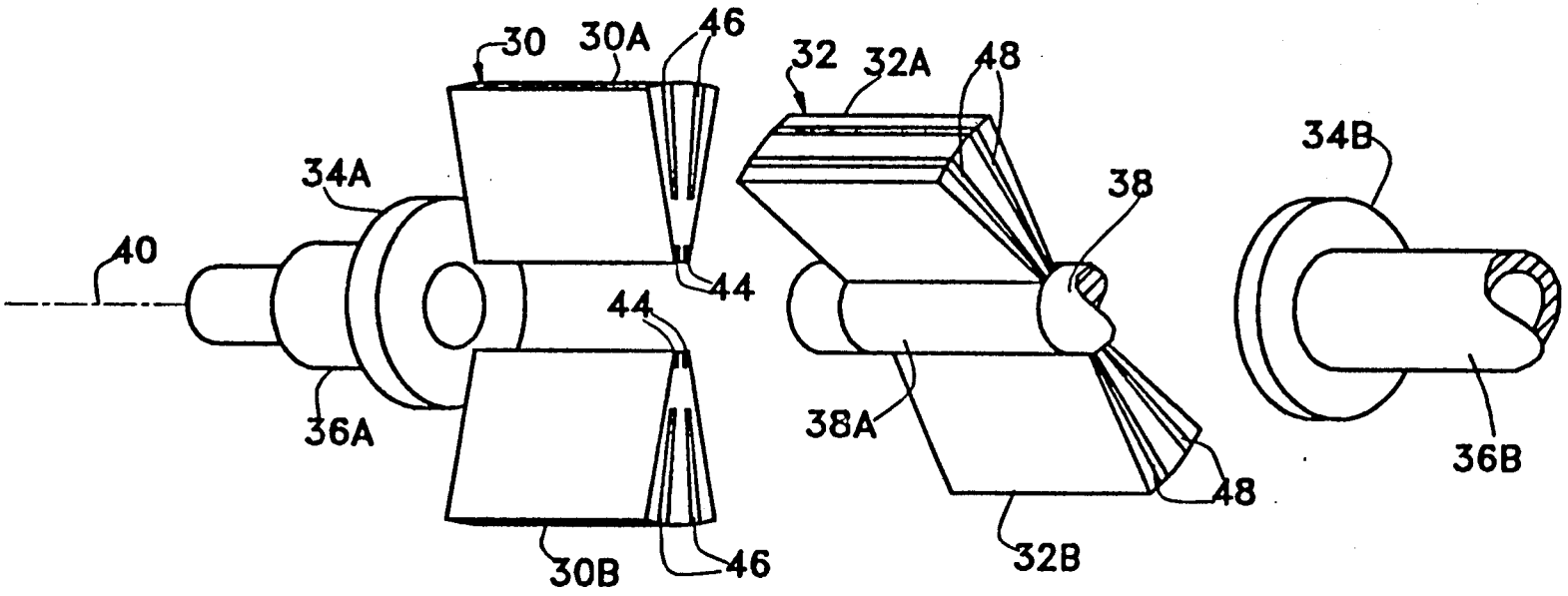
FIG. 2 is an enlarged exploded isometric view, partly in section, of the piston assemblies included in the engine.
Figure 4:
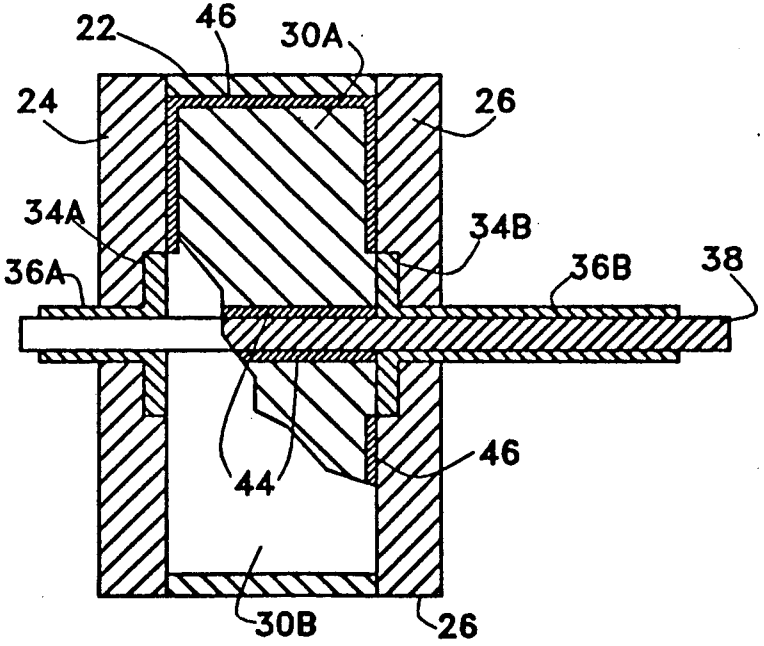
FIG. 4 is a cross-sectional view taken substantially along line 4—4 of FIG. 1.
Figure 3:
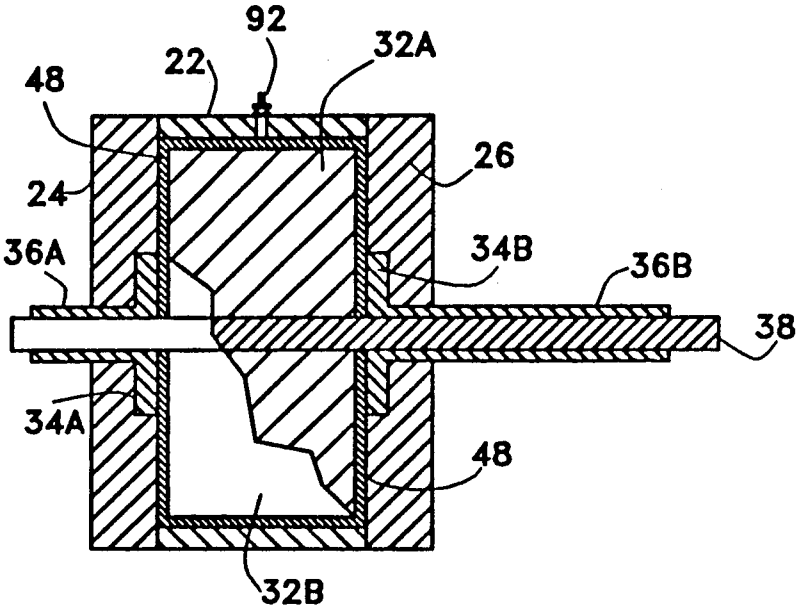
FIG. 3 is a cross-sectional view taken substantially along line 3—3 of FIG. 1.

Reference first is made to FIG. 1 of the drawings wherein the engine 20 of this invention is shown to include a stationary housing 22 having a cylindrical bore which is closed at opposite ends by end plates 24 and 26 attached thereto as by bolts or other suitable means, not shown, to form a cylindrical working chamber. In the engine shown in FIG. 1, the working chamber is divided into first and second pairs of diametrically opposite sub-chambers by pistons included in first and second piston assemblies 30 and 32. As seen also in FIG. 2, piston assembly 30 includes a pair of diametrically opposed pistons 30A and 30B, and piston assembly 32 includes a pair of diametrically opposed pistons 32A and 32B. The engine cylinder and pistons are also shown in FIGS. 3 and 4 of the drawings.

Pistons 30A and 30B are affixed to hubs 34A and 34B at facing ends of tubular piston shaft sections 36A and 36B, respectively. Shaft sections 36A and 36B together with associated hubs 34A and 34B, are supported for rotation about the axis of the cylindrical bore in housing 22 by end plates 24 and 26, respectively, through suitable bearing means, not shown. Hubs 34A and 34B are located in recesses formed at the inner walls of the end plates. An inner piston shaft 38 is rotatably mounted in the tubular shaft sections 36A and 36B and extends therebetween. Pistons 32A and 32B of second piston assembly 32 are attached to inner piston shaft 38 at diametrically opposite positions. Shaft 38 may be formed in interengagable sections, including section 38A to which pistons 32A and 32B are attached, to facilitate assembly, which shaft sections rotate as a unit when in the illustrated engaged condition. Piston assemblies 30 and 32 are rotatable about a common axis 40 and, in operation, rotate in the same direction as indicated by arrow 42.

The working chamber is divided into two pairs of diametrically opposite sub-chambers by the four wedge-shaped pistons 30A, 30B, 32A and 32B. As will become apparent, the piston assemblies operate at periodically variable speeds such that periodically variable volume sub-chambers are provided between adjacent pistons. With this illustrated piston construction, sealing of sub-chambers to prevent the flow of gases therebetween is easily facilitated. As best seen in FIG. 2, inner concave surfaces of pistons 30A and 30B are provided with straight seal means 44 which engage inner piston shaft section 38A. Generally U-shaped seal means 46 extend along the outer convex surfaces of pistons 30A and 30B, and along opposite ends thereof, for sealing engagement between the pistons and cylinder walls. Similarly, generally U-shaped seal means 48 extend along the outer convex surfaces of pistons 32A and 32B, and along opposite ends thereof, for sealing engagement between these pistons and cylinder walls.

In the embodiment of the invention illustrated in FIG. 1, a gear train 54 which includes two pairs of circular gear sets 56 and 58, and multiple levels of ellipsoidal gears including at least four pairs of eccentric elliptical gears 60, 62, 64 and 66, are employed in the interconnection of outer and inner piston shafts 36B and 38 for control of the relative movement of piston assemblies 30 and 32 during rotation thereof. For the illustrated 4-piston engine, circular gear pairs 56 and 58 are provided with a 1:2 gear ratio whereby the eccentric elliptical gears 60, 62, 64 and 66 undergo two complete revolutions for each complete revolution of piston shafts 36B and 38. Suffixes A and B are used to identify separate gears in the gear pairs.

As seen in FIG. 1, gears 56B and 60A are affixed to tubular idler shaft 70 which, in turn, is rotatably mounted on rotatable engine output shaft 72. Coaxial shafts 70 and 72 rotate about an axis 74. Similarly, gears 58B and 66B are affixed to tubular idler shaft 76 which also is rotatable on output shaft 72 about axis 74. Eccentric elliptical gear 60B of gear pair 60 together with eccentric elliptical gear 62A of gear pair 62 are affixed to idler shaft 78 which is rotatable about shaft axis 80. Similarly, eccentric elliptical gears 66A and 64B are affixed to idler shaft 82 which also is rotatable about axis 80. Eccentric elliptical gears 62B and 64A of gear pairs 62 and 64 are attached to output shaft 72 for interconnection thereof and drive actuation of the output shaft.

It here will be noted that all of the pairs 60, 62, 64 and 66 of eccentric elliptical gears in the gear train connecting piston shaft 36B to piston shaft 38 rotate in substantially the same phased relationship. For example, in the position of the gear train illustrated in FIG. 1, rotation of shaft 70 by gear set 56 one-eighth of a turn will result in a much larger angular rotation of shaft 76 since the elliptical gear sets simultaneously function as step-up gears. Examination of the ellipsoidal gear train reveals that rotation is alternately stepped up and stepped down during successive one-half cycles of rotation thereof because of the in-phase relationship of the eccentric elliptical gear sets 60, 62, 64 and 66 in the interconnection of idler shafts 70 and 76.

As seen in FIG. 1, engine housing 22 is provided with an exhaust port 86 followed, in the direction of piston travel, by an intake port 88. Next, in the direction of piston travel, a fuel injection nozzle 90 is provided which is connected to a source of fuel, through which nozzle fuel is injected into the sub-chambers following intake of air through inlet port 88. Finally, ignition device 92, such as a spark plug, is provided for ignition of the compressed air/fuel mixture contained in the sub-chamber.

Figure 5:
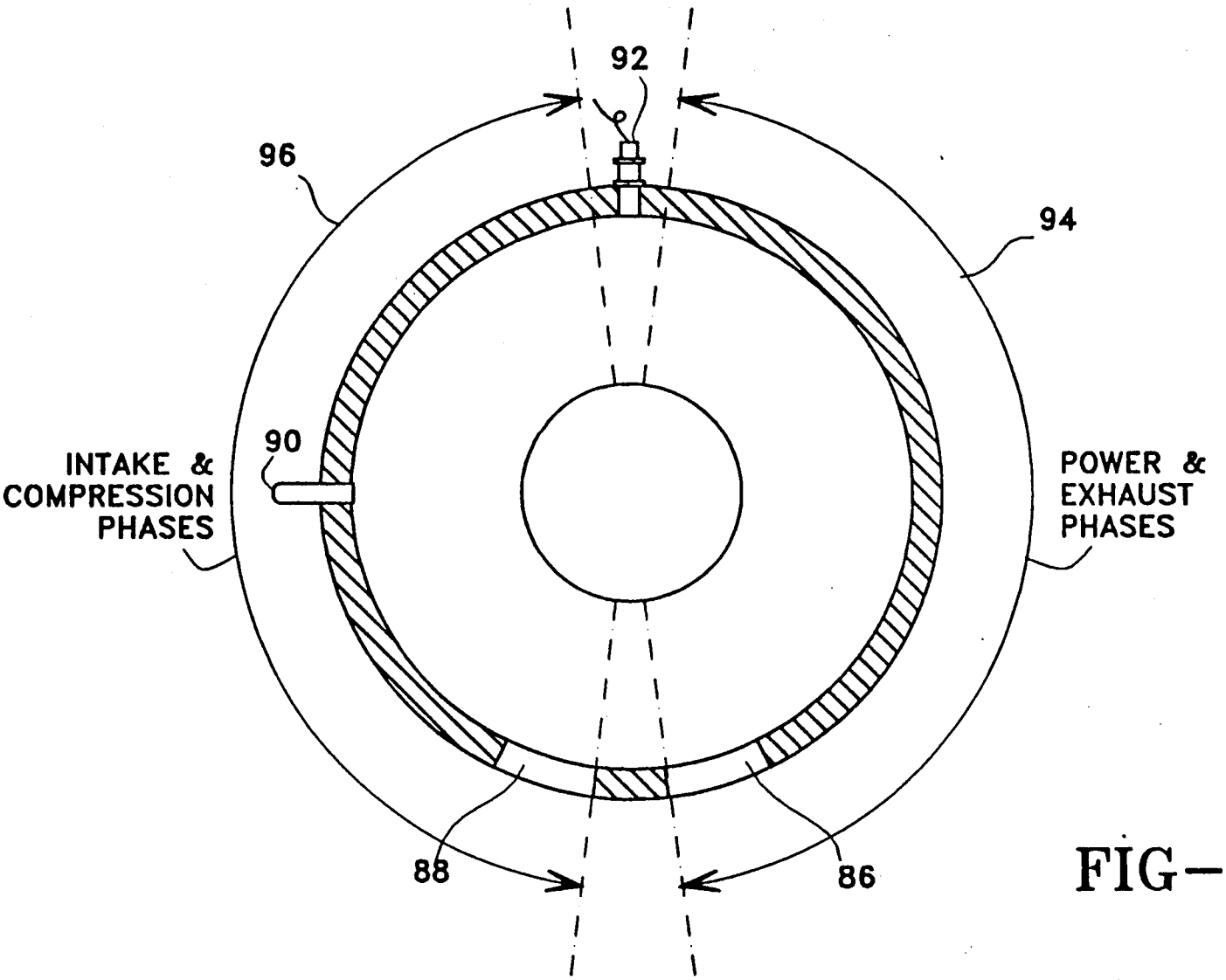
FIG. 5 is a schematic illustration showing separation of functions within the engine chamber.

With the illustrated four-piston engine, the operating chamber is divided into four sub-chambers. Referring to FIG. 5, power and exhaust phases of engine operation occur during angular piston movement identified by double-headed arrow 94, and intake and compression phases occur during angular piston movement identified by double-headed arrow 96. It will be seen that all engine operating phases occur over angular-piston movements of somewhat less than 180 degrees. That is, substantially one-half of the engine working chamber is used solely for intake and compression functions, and substantially the other one-half is used solely for power and exhaust functions.

Reference now is made to FIGS. 6A–6D wherein sequential operating positions of the engine pistons are schematically illustrated and functions at the four engine sub-chambers are identified in chart form. Sub-chambers are identified by the two adjacent pistons between which the sub-chamber is formed and by the letters A, B, C and D. In the engine schematics, the spark plug is located adjacent the top of the engine housing, and the spark plug and inlet and outlet ports are located in the same relative positions as illustrated in FIG. 1. In the illustrated engine operation, a fuel/air mixture is supplied to the engine through the inlet port, in which case fuel injection means are not required. If fuel injection is employed, then injection of fuel either during the compression phase or, at the end of the compression phase at the point labeled "ignition", would be employed. Regardless of how and when fuel is introduced into the sub-chambers, or how it is ignited, FIGS. 6A–6D illustrate engine operation advantages provided by inclusion of the eccentric elliptical gear sets 60, 62, 64 and 66 included in gear train 54 employed in the engine of this invention. The piston assemblies are shown at five different positions in each of drawings 6A through 6D, which positions are labeled through 5. Together, drawing FIGS. 6A through 6D show angular positions of the piston assemblies which occur during one complete revolution thereof. It here will be noted that output shaft 72, shown in FIG. 1, completes two revolutions for each revolution of the piston assemblies because of step-up gears 56 and 58 included in the interconnection of the piston shafts 36B and 38.

At position 1 of FIG. 6A, ignition takes place in sub-chamber A between pistons 30A and 32A when the sub-chamber is at substantially its smallest volume, compression starts in the sub-chamber B, air/fuel mixture starts to be drawn into sub-chamber C through inlet port 88, and the exhaust of spent gases through exhaust port 86 begins at sub-chamber D. The power, compression, intake and exhaust phases occurring at the respective sub-chambers A, B, C an C continue from position 1 through position 5 of the piston assemblies shown in FIG. 6A.

In piston assembly travel from position 1 to position 5 of FIG. 6A, one phase of the four phase operating cycle is completed within each of the sub-chambers. Then, as shown in FIG. 6B, sub-chambers A, B, C and D undergo exhaust, power, compression and intake phases, respectively. Next, sub-chambers A, B, C and D undergo intake, exhaust, power and compression phases, respectively, as shown in FIG. 6C. Finally, as shown in FIG. 6D, sub-chambers A, B, C and D undergo compression, intake, exhaust and power phases, respectively, at the end of which time piston assemblies 30 and 32 each have completed one revolution of travel. It will be seen, then, that a complete engine operating cycle takes place at each sub-chamber with each complete rotation of the piston assemblies, for a total of four complete engine operating cycles per revolution of the piston assemblies.

With the illustrated gear train, which in the FIG. 1 embodiment includes at least four pairs of eccentric elliptical gears 60, 62, 64 and 66 operating in the same phased relationship, the trailing piston associated with the power phase of engine operation (and intake phase) rotates only a small angular distance compared to rotation of the associated leading piston. For example, between positions 1 and 5 of FIG. 6A, rotation of trailing piston 32A is shown as approximately one-third that of leading piston 30A during the power phase in sub-chamber A. (The same relationship applies to relative travel of trailing and leading pistons 32B and 30B for the simultaneously occurring intake phase at sub-chamber C.) With the present invention, elliptical gear means in the gear train connecting the piston assemblies may be constructed to provide trailing pistons in the power phases with a minimum rotation. By minimizing travel of the trailing piston relative to the leading piston during the power phase, energy lost due to such travel of the trailing piston is minimized, and engine efficiency is improved. With prior art arrangements, such as shown in U.S. Pat. No. 3,398,643, which employ two pairs of conventional eccentric elliptical gears in the interconnection of the piston assemblies, relative piston travel is limited by the maximum ellipticity that the elliptical gears may be provided with. If, for example, the gears have too high ellipticity, they may advertently disengage during operation. In the embodiment of the invention shown in FIG. 1, which utilizes at least two additional sets of eccentric elliptical gears in the gear train in rotational phased relationship with the other eccentric elliptical gears, a large effective ellipticity may be provided without the need for employing individual gear sets with high ellipticity. With the illustrated in-phase, series connected, eccentric elliptical gears, the piston assemblies may be made to rotate with a large difference in relative rates which, in turn, provides for the small rotational movement of trailing pistons during the power phases.

Figure 7:
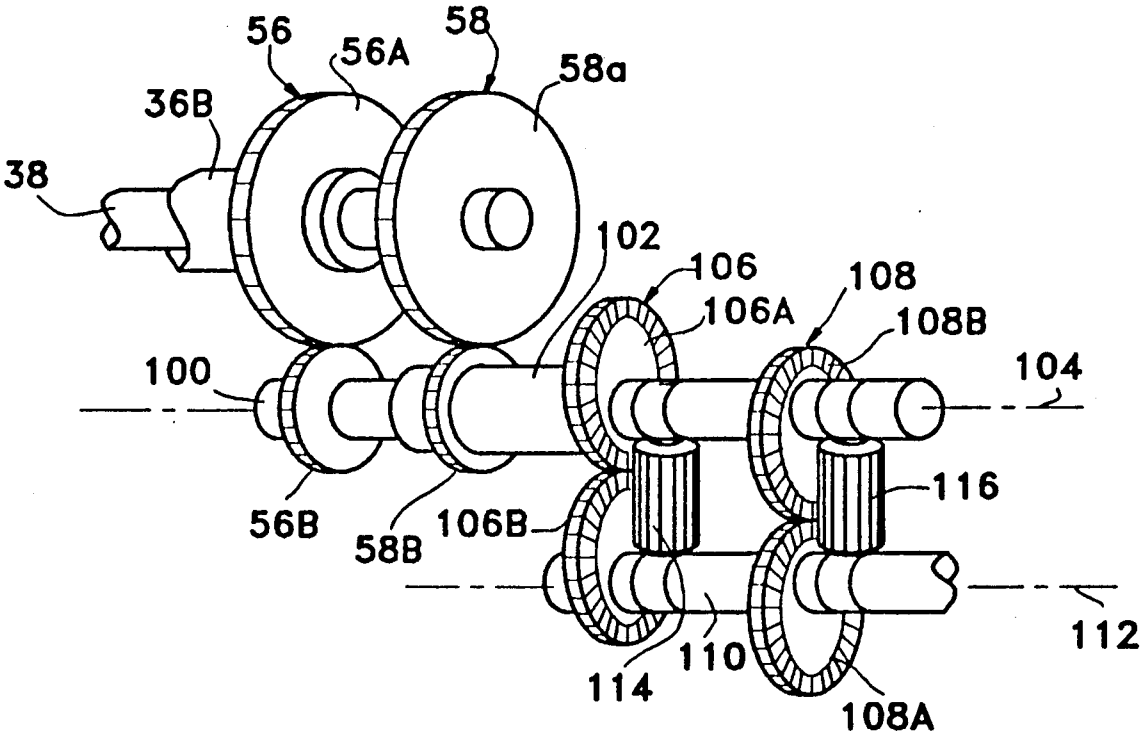
FIG. 7 is an isometric view of an alternative gear arrangement employing compound eccentric ellipsoidal gears for use in the present invention.

Another means to provide for a high relative ellipticity gear train is shown in FIG. 7, to which figure reference now is made. There, coaxial piston shafts 36B and 38 together with circular step-up gear sets 56 and 58 are shown which correspond to elements shown in FIG. 1 and described above. In the FIG. 7 arrangement, gears 56B and 58B are affixed to inner and outer coaxial idler shafts 100 and 102 rotatable about axis 104. Shafts 100 and 102 are interconnected by first and second pairs of compound eccentric elliptical gear sets 106 and 108. Gear 106A of gear set 106 is affixed to the end of idler shaft 102, and intermeshing gear 106B is attached to an output shaft 110 rotatable about shaft axis 112. Eccentric elliptical gear 108A also is attached to the output shaft 110, and meshes with eccentric elliptical gear 108B attached to inner idler shaft 102. Conventional generally radially extending gear teeth on gear sets 106 and 108 provide for a drive connection between intermeshing gear in the well known prior art manner.

Figure 8:
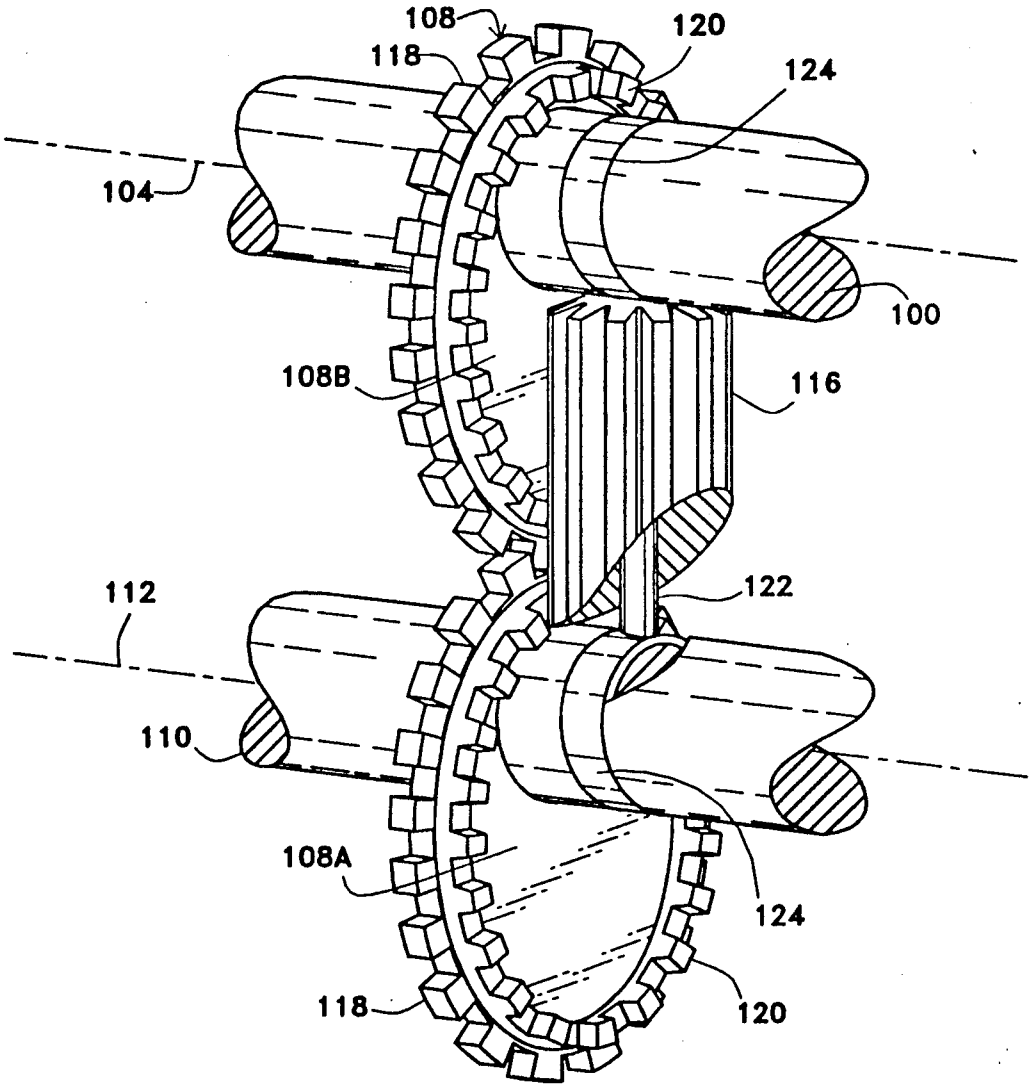
FIG. 8 is an enlarged isometric view of a pair of eccentric elliptical gears of the type shown in FIG. 7.

In accordance with this invention, compound gears 106 and 108 are provided with a second set of gear teeth which extend axially from one face thereof, and which are interconnected through idler gears 114 and 116, respectively. Reference now is made to FIG. 8 wherein an enlarged view of compound gear set 108 is shown, with parts shown broken away for clarity. Both compound gear sets 106 and 108 are of the same design so that a description of one will suffice for an understanding of both. In FIG. 8, the generally radially extending gear teeth are identified by reference numeral 118,118 and the generally axially extending gear teeth are identified by reference numeral 120, 120. The axially extending teeth also are arranged in an eccentric elliptical pattern, the ellipticity of which pattern corresponds to that of the generally radially extending set of teeth.

Idler gear 116 is rotatably mounted on a shaft 122, the axis of which is normal to the rotational axes 104 and 112 of the respective compound gears 108B and 108A. Opposite ends of shaft 122 are affixed to annular bearing members 124,124 through which rotatable shafts 102 and 110 extend for support of shaft 122. Suitable means, not shown, are provided for attaching and removing members 124, 124 to and from the associated shafts. For example, split bearings, the components of which are removably interconnected as by bolting, may be used. In any event, gear supporting shaft 122 is positioned so that gear teeth on idler gear 116 engage generally axially extending teeth 120 of the compound eccentric elliptical gears thereby providing a second gear interconnection therebetween.

The present compound eccentric elliptical gears of this invention may be formed with a very large eccentricity without loss of operability due to inadvertent de-meshing of gears. Inadvertent loss of intermeshing engagement of the ellipsoidal gears is avoided by use of idler gear 116 which remains engaged with axially extending teeth 120 at all times regardless of the gear ellipticity. By using sets of eccentric elliptical gears with large eccentricity, rotation of trailing pistons relative to leading pistons, during power and intake phases of engine operation, may be made very small. By making the difference in the relative rate of rotation of trailing and leading pistons large during the power phase, energy efficiency of the engine is substantially increased.

Figure 9A:
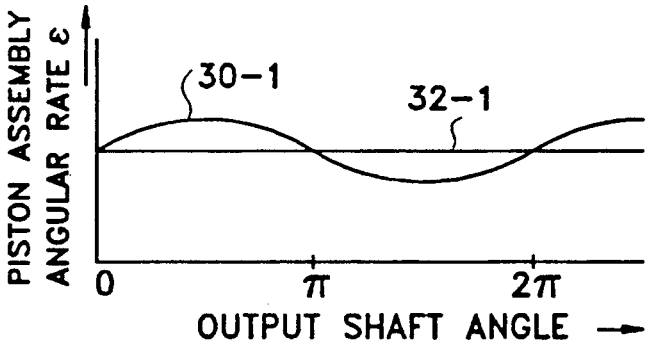
FIGS. 9A through 9E show plots of angular speed of piston assemblies versus output shaft angular position for engines employing different eccentric ellipsoidal gear trains schematically illustrated in FIGS. 9A-1 through 9E-1, respectively.
Figure 9B:
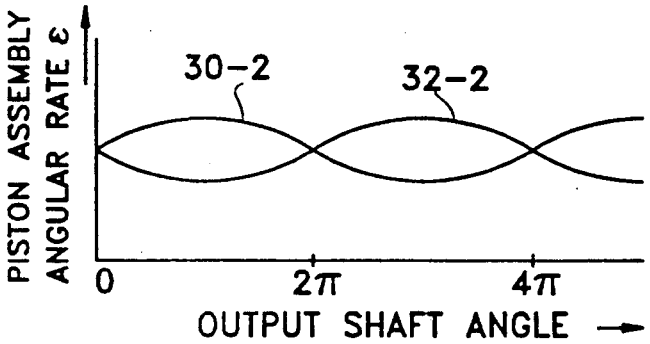
Figure 9C:
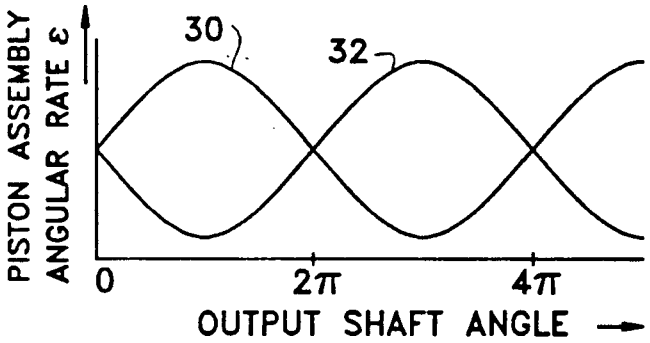
Figure 9D:
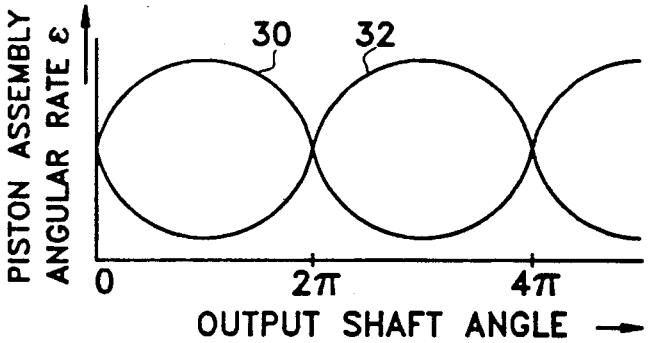
Figure 9E:
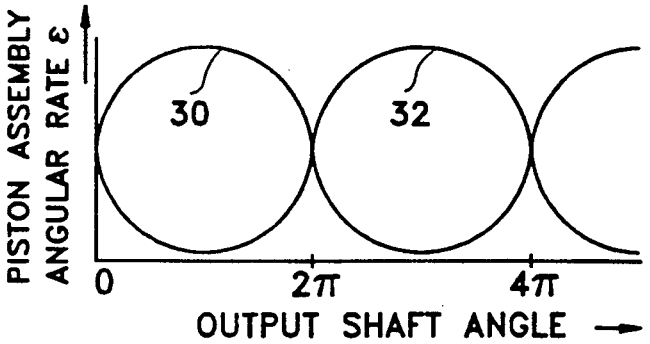
Figures 1, 9A:
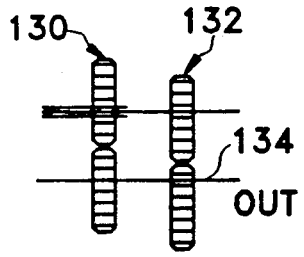
Figures 1, 9B:
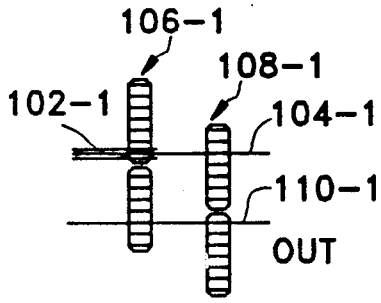
Figures 1, 9C:
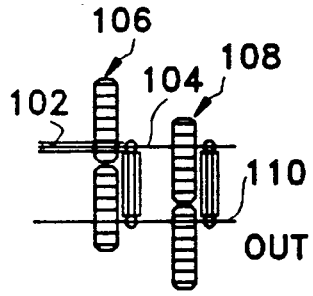
Figures 1, 9D:
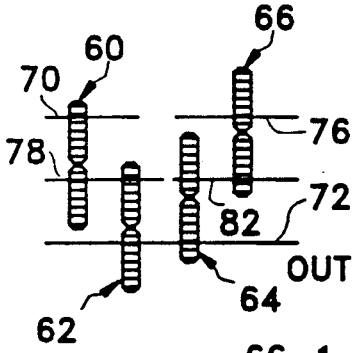
Figures 1, 9E:
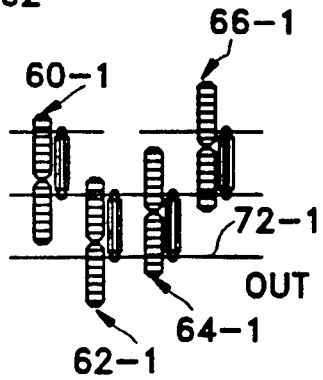

Advantages of the present engine construction over prior art arrangements are illustrated in FIGS. 9A through 9E, and associated FIGS. 9A-1 through 9E-1, of the drawings where plots of piston assembly angular rate versus output shaft angular position are shown for engines having different eccentric gear arrangements in the interconnection of piston assemblies, all of which plots are based upon engine operation at the same output shaft rotational rate. In FIGS. 9A and 9A-1, operation of an engine of the type shown in Japanese application 58-79623 dated May 13, 1983 is illustrated. One piston assembly is connected through a set of eccentric gears 130 to the output shaft 134 whereas the other piston assembly is connected through circular gear set 132 to the output shaft. The angular rate of rotation of one piston assembly 32-1 is constant while piston assembly 30-1 operates at a variable rate. As seen in the graph of FIG. 9A, there is only a small change in angular rate of rotation of the two piston assemblies. Consequently, during the expansion phase, the trailing piston rotates at nearly the same rate of rotation as the leading piston which results in very inefficient engine operation.

Operation of an engine of the type shown in U.S. Pat. No. 3,398,643—Schudt is illustrated in FIGS. 9B and 9B-1, to which figures reference now is made. The gear train employed in this prior art engine is of substantially the same type shown in FIG. 7, but with the major difference that plain elliptical gears are employed instead of the compound eccentric elliptical gears shown in FIG. 7. In FIG. 9B-1, outer and inner engine shafts 102-1 and 104-1 are connected by eccentric elliptical gear sets 106-1 and 108-1, respectively, to an output shaft 110-1. Although the angular rate of rotation of both piston assemblies 30-2 and 32-2 varies, the difference in rates is limited by the eccentricity with which gear sets 106-1 and 108-1 may be provided.

FIG. 9C shows a plot of angular rate versus output shaft angle for a rotary piston engine of the type shown in FIG. 4 but including the compound eccentric gears of the type shown in FIGS. 7 and 8 (See FIG. 9C-1). There, because of the greater eccentricity of gear sets 106 and 108, relative to gear sets 106-1 and 108-1, pistons 30 and 32 operate over a wider angular rate than pistons 30-2 and 32-2 shown in FIG. 9B. Obviously, the eccentricity of gear sets 106 and 108 is greater than that of gear sets 106-1 and 108-1 shown in FIG. 9B-1, which increased eccentricity is made possible by inclusion of idler gears between associated gears of the gear sets. It will be seen that the lowest angular rate of piston assemblies 30 and 32 of the FIG. 9C-1 arrangement is less than that of piston assemblies 30-2 and 32-2 of the FIG. 9B-1 arrangement.

In FIG. 9D operation of the engine shown in FIG. 1 is illustrated. As described above, this engine includes four pairs of eccentric elliptical gears 60, 62, 64 and 66 schematically illustrated in FIG. 9D-1. The maximum difference in angular rate of piston assemblies is somewhat greater in the FIG. 9D-1 arrangement than in the FIG. 9C-1 arrangement, and the difference in angular rate throughout much of the operating cycle is greater.

In FIG. 9E, operation employing four compound gear sets 60-1, 62-2, 64-1 and 66-1 seen in FIG. 9E-1 is shown. Again, since the gear sets include idler gears to prevent inadvertent disengagement, gears with greater eccentricity may be employed than in gear sets 60, 62, 64 and 66 included in the FIG. 9D-1 arrangement. The angular rate versus output shaft angle plots for piston assemblies 30 and 32 are similar to those shown in FIG.

9D except that a lower angular velocity is reached, and the difference in angular velocity is greater throughout much of the operating cycle. It here will be noted that the area between plots of associated piston assembly angular rates is related to engine operating efficiency; the greater the area the greater the efficiency.

Figure 10:
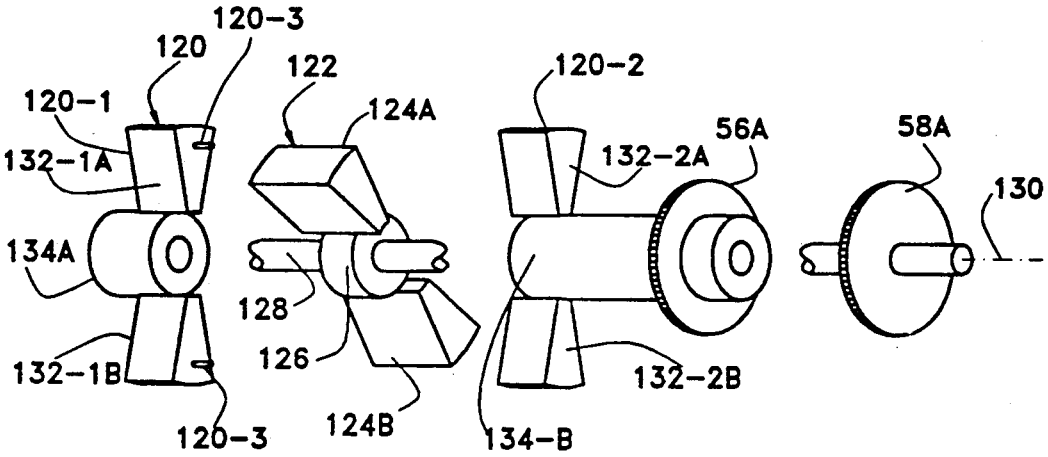
FIG. 10 is an exploded, isometric view, partly in section, of a modified piston design for use in the present engine.
Figure 11:
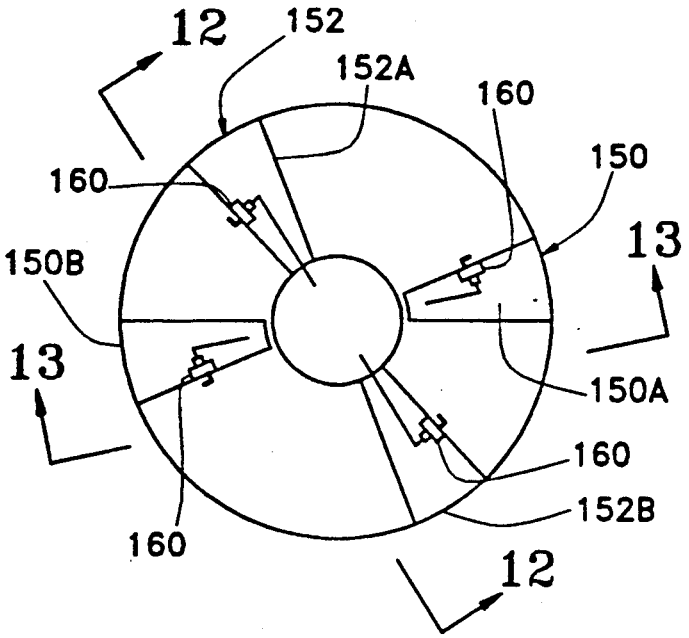
FIG. 11 is a schematic illustration showing a modified form of engine wherein spark plugs are carried by engine pistons.

It will be apparent that piston assembly construction is not limited to that shown in FIGS. 1 and 2. A modified form of piston assembly is shown in FIG. 10, to which figure reference now is made. There an exploded view of piston assemblies 120 and 122 is shown. One piston assembly 122 includes a pair of wedge shaped pistons 124A and 124B attached to a hub 126, which, in turn, is affixed to an inner shaft 128 rotatable about axis 130. To facilitate construction and assembly, the second piston assembly 120 is made of two sections 120-1 and 120-2 interconnected as by use of bolts 120-3 that extend through apertures in one section and threadly engage threaded apertures in the other section. Section 120-1 includes a pair of diametrically opposite wedge shaped piston sections 132-1A and 132-1B attached to a tubular outer shaft section 134A. Section 120-2 includes a similar pair of piston sections 132-2A and 132-2B attached to tubular outer shaft section 134B. Shaft sections 134A and 134B are rotatable about the same axis 130 about which inner shaft 128 rotates. As in the FIG. 1 arrangement, circular gears 56A and 58A are attached to outer and inner shafts 134B and 128, respectively, and eccentric elliptical gears, not shown, are included in the interconnection of gears 56A and 58A in a manner described above. The piston assemblies 120 and 122 are provided with suitable seal means, not shown, for sealing engagement with the cylindrical working chamber of the engine housing and parts of the piston assemblies.

Where spark ignition is employed, as in the arrangement of FIG. 1, ignition timing is limited, of course, to the time period during which the compressed fuel-air mixture is in communication with the ignition device 92. By locating ignition devices on the pistons, such as diagrammatically illustrated in FIGS. 11, 12 and 13, ignition timing may be adjusted as desired. There, piston assemblies 150 and 152, are shown, each of which includes a pair of pistons 150A and 150B, and 152A and 152B, respectively. Piston assembly 150 is affixed to outer shaft sections 154A and 154B, and piston assembly 152 is affixed to coaxial inner shaft 156. Ignition devices 160 such as spark plugs are carried by the pistons and arranged such that a spark plug gap is provided at each sub-chamber. If the pistons rotate in a clockwise direction as viewed in FIG. then the spark plugs are shown located at the trailing piston faces. At least one spark plug is provided at each of the four sub-chambers into which cylinder chamber is divided by the four pistons.

Figure 12:
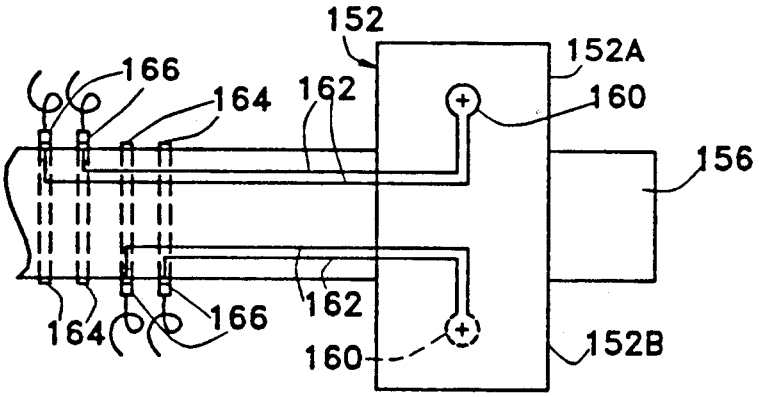
FIG. 12 is a schematic view taken along line 12—12 of FIG. 11.
Figure 13:
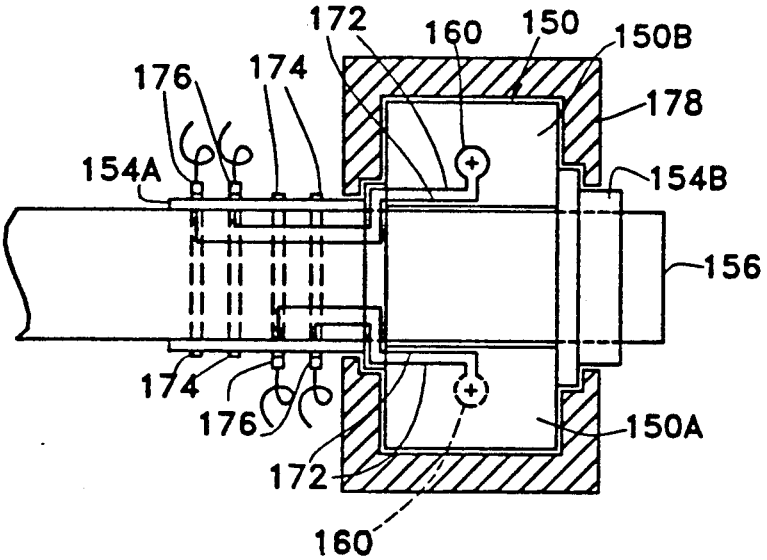
FIG. 13 is a schematic view taken along line 13—13 of FIG. 11.

As seen in FIG. 12, spark plug wires 162 for spark plugs 160 carried by piston assembly 152 extend from the spark plugs to annular conducting rings 164 on inner shaft 156. Brushes 166 in electrical contact with rings 164 provide for electrical connection of wires 162 to a source of ignition current, not shown. As seen in FIG. 13, spark plug wires 172 for spark plugs 160 carried by piston assembly 150 extend from the spark plugs to annular conducting rings 174 on outer shaft section 154A, and brushes 176 in electrical contact with rings 174 provide for electrical connection of wires 172 to take ignition current source. In FIG. 13, engine housing 178 also is shown. With this arrangement ignition timing control over a wide range of piston rotation is possible since spark plugs 160 remain in communication with their associated sub-chambers at all times.

Figure 14:
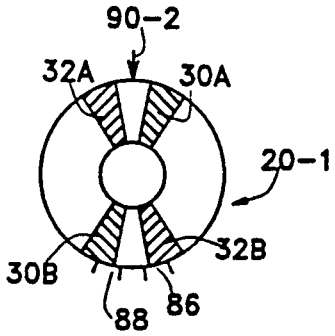
FIG. 14 schematically illustrates a portion of a compression ignition type engine for use with the present invention.

Operation of the novel engine using compression ignition also is contemplated as illustrated in FIG. 14, to which figure reference now is made. There, engine portion 20-1 is shown which includes inlet and exhaust ports 88 and 86, respectively. Air, not an air/fuel mixture is supplied to the engine through inlet port 88, and no spark plug is included. Instead, a high pressure fuel injector 90-2 is located at a point that the spark plug 92 in the spark ignition engine was located. When the sub-chamber between pistons 30A and 32A reaches the substantially maximum pressure, minimum volume, condition illustrated in FIG. 14, fuel from fuel injector 90-2 is sprayed into the sub-chamber, which fuel is compression ignited by the high temperature of the compressed air for start of a power phase. Operation proceeds in the manner illustrated in FIGS. 6A-6D and described above except that compression ignition rather than spark ignition is employed, and air rather than an air/fuel mixture is supplied to the engine during the intake phase.

The invention having been described in detail in accordance with requirements of the U.S. Patent Statutes, various other changes will suggest themselves to those skilled in this art. For example, it will be apparent that for those embodiments wherein spark plugs are carried by the pistons, it is not required that every piston be provided with a spark plug. Instead, alternate pistons may be provided with spark plugs at both the trailing and leading faces thereof. For example, in the arrangement shown in FIG. 11, pistons 152A and 152B of piston assembly 152 may be provided with a second spark plug at the opposite face thereof, in which case no spark plugs would be required to be carried by piston assembly 150. Also, it will be apparent that output shaft 72 with affixed gears 62B and 64A need not be coaxial with shafts 70 and 76. Output shaft 72 may be located along an axis parallel to the axis along which shafts 78 and 82 are located, in the manner diagrammatically illustrated in FIG. 9D. It is intended that the above and other such changes and modifications shall fall within the spirit and scope of the invention defined in the appended claims.

I claim:

1. In an internal combustion engine including a housing forming a cylindrical working chamber having inlet and exhaust ports, first and second piston assemblies each of which assemblies includes at least one pair of diametrically opposed pistons within the working chamber rotatable about the cylinder axis and dividing the chamber into a plurality of pairs of diametrically opposed sub-chambers, a gear train for interconnecting said first and second piston assemblies including first and second pairs of intermeshing eccentric elliptical gears, each pair of which elliptical gears rotate in substantially the same phased relationship for rotation of the first and second piston assemblies in the same direction at recurrently variable speeds whereby at least one pair of diametrically opposite sub-chambers decrease in volume while at least one other pair of diametrically opposite sub-chambers increase in volume, for each complete revolution of the first and second piston assemblies a plurality of operating cycles being completed, each operating cycle including successive power, exhaust, intake and compression phases, wherein the improvement in said internal combustion engine comprises:

at least two more pairs of interconnected eccentric elliptical gears in said gear train between said first and second pairs of elliptical gears in substantially the same phased relationship with said first and second pairs of elliptical gears to increase the difference in the relative rate of rotation of the first and second piston assemblies during operation for decreasing the rate of rotation of trailing pistons during the power and intake phases relative to that of leading pistons, and means for obtaining output from the interconnection between said two more pairs of eccentric elliptical gears.

2. In an internal combustion engine as defined in claim 1 wherein at least two pairs of said eccentric elliptical gears comprise compound gears.

3. In an internal combustion engine as defined in claim 2 wherein said compound gears comprise generally axially extending teeth in an elliptical pattern at at least one face of intermeshing gears, and an idler gear intermeshing with generally axially extending teeth on compound eccentric elliptical gears to provide a second gear connection between intermeshing eccentric elliptical gears.

4. In an interval combustion engine as defined in claim 1 including spark plugs carried by pistons of at least one piston assembly and having electrodes with spark gaps in communication with each sub-chamber for initiating said power phases.

5. In an internal combustion engine as defined in claim 4 including conducting rings rotatable with at least one piston assembly about the cylinder axis and electrically connected to said spark plugs, and brushes in sliding engagement with said conducting rings adapted for connection to a voltage source for application of spark-producing voltage to the spark plugs.

6. In an internal combustion engine as defined in claim 1 wherein said piston assemblies each include only a single pair of diametrically opposed pistons.

7. In an internal combustion engine as defined in claim 1 including a pair of spaced axially aligned rotatable tubular shaft sections between which pistons included in the first piston assembly are supported at diametrically opposed locations, and an inner rotatable shaft coaxial with said tubular shaft sections and extending between said shaft sections and between diametrically opposed pistons of the first piston assembly, to which inner shaft pistons included in the second piston assembly are attached.

8. In an internal combustion engine as defined in claim 7 including axially extending seal means between said inner shaft and pistons supported by said tubular shaft sections.

9. In an internal combustion engine as defined in claim 1 including fuel injection means for supplying fuel to the sub-chambers during each compression phase which, when ignited, initiates the power phase.

10. In an internal combustion engine as defined in claim 9 including a spark plug carried by the housing at a point where sub-chamber volume is substantially minimum for igniting fuel within the sub-chamber.

11. In an internal combustion engine as defined in claim 9 wherein said fuel injection means supplies fuel to the sub-chambers at substantially the end of the compression phase for compression ignition of the fuel.

12. In an internal combustion engine the combination comprising:

a housing forming a cylindrical working chamber having inlet and exhaust ports, first and second piston assemblies each of which includes at least one pair of diametrically opposed pistons within the working chamber rotatable about the cylinder axis and dividing the chamber into a plurality of pairs of diametrically opposed sub-chambers, a gear train for interconnecting said first and second piston assemblies including first and second pairs of intermeshing compound eccentric elliptical gears, generally axially extending teeth in an eccentric elliptical pattern at at least one face of the first and second pairs of compound gears, first and second idler gears intermeshing with generally axially extending teeth on the respective first and second pairs of compound gears to provide a second gear connection between intermeshing eccentric elliptical gears, each pair of compound elliptical gears rotate in substantially the same phased relationship for rotation of said first and second piston assemblies in the same direction at recurrently variable speeds whereby some opposite sub-chambers decrease in volume while other opposite sub-chambers increase in volume, for each complete revolution of the first and second piston assemblies a plurality of operating cycles being completed equal in number to the total number of pistons, each operating cycle including successive power, exhaust, intake and compression phases.

13. In an internal combustion engine as defined in claim 12 including, at least two more pairs of eccentric elliptical gears in said gear train which rotate in substantially the same phased relationship with said compound eccentric elliptical gears.

14. In an internal combustion engine as defined in claim 12 including spark plugs carried by pistons of at least one piston assembly and having electrodes with spark gaps in communication with each sub-chamber for initiating said power phases.

15. In an internal combustion engine as defined in claim 14 including conducting rings rotatable with at least one of said piston assemblies about the cylinder axis and electrically connected to said spark plugs, and brushes in sliding engagement with said conducting rings adapted for connection to a voltage source for application of spark-producing voltage to the spark plugs.

16. In an internal combustion engine as defined in claim 12 wherein each said piston assembly includes only a single pair of diametrically opposed pistons.

17. In an internal combustion engine as defined in claim 12 including a pair of spaced axially aligned rotatable tubular sections between which pistons of the first piston assembly are supported at diametrically opposed locations and an inner rotatable shaft coaxial with said tubular shaft sections and extending between said shaft sections and between diametrically opposed pistons of the first piston assembly, to which inner shaft pistons of the second piston assembly are attached.

18. In an internal combustion engine as defined in claim 17 including axially extending seal means between said inner shaft and pistons of the first piston assembly.

19. In an internal combustion engine as defined in claim 12 including fuel injection means for supplying fuel to the sub-chambers during each compression phase which, when ignited, initiates the power phase.

20. In an internal combustion engine as defined in claim 19 including a spark plug carried by the housing at a point where sub-chamber volume is substantially minimum for igniting fuel within the sub-chamber.

21. In an internal combustion engine as defined in claim 19 wherein said fuel injection means supplies fuel to the sub-chambers at substantially the end of the compression phase for compression ignition of the fuel.

22. A gear set for coupling first and second shafts having parallel extending axes comprising:

first and second compound eccentric elliptical gears adapted for rotation about said first and second shaft axes, generally radially extending intermeshing teeth on said gears for transmission of motion between said first and second gears upon rotation of one of said gears, generally axially extending teeth in an eccentric elliptical pattern at at least one face of the first and second gears, and an idler gear rotatable about an axis which intersects the first and second shaft axes and meshing with axially extending teeth of said first and second gears for interconnection of said first and second gears through said idler gear.

23. A gear set as defined in claim 22 including an idler gear supporting shaft for rotatable support of said idler gear, and bearing members at opposite ends of said idler gear supporting shaft for support by said first and second shafts.

* * * * *